US005490639A

United States Patent [19]

Droutsas

[11] Patent Number: 5,490,639

[45] Date of Patent: Feb. 13, 1996

[54] MULTI-RAIL TENSION EQUALIZER

[75] Inventor: Christos F. Droutsas, Newark, Calif.

[73] Assignee: National Semiconductor Corporation, Santa Clara, Calif.

[21] Appl. No.: 172,092

[22] Filed: Dec. 22, 1993

[51] Int. Cl.[6] ..... B65H 35/02

[52] U.S. Cl. ..... 242/525.1; 242/530.3; 242/538.1; 437/220

[58] Field of Search ..... 242/525, 530, 242/530.1, 530.3, 538, 538.1; 437/220; 148/411

[56] References Cited

U.S. PATENT DOCUMENTS

| | | | |
|---|---|---|---|
| 2,120,473 | 6/1938 | Sheperdson | 242/530 |
| 2,417,001 | 3/1947 | Leroy et al. | 242/530.4 |
| 2,766,950 | 10/1956 | Speed et al. | 242/530.1 |
| 3,406,924 | 10/1968 | Bruns et al. | 242/530.1 |
| 3,982,317 | 9/1976 | Eysermans | 29/588 |
| 4,063,993 | 12/1977 | Burns | 156/659 |
| 4,093,140 | 6/1978 | Matsunaga | 242/530 |
| 4,094,474 | 6/1978 | Stollenwerk et al. | 242/530.1 |
| 4,201,352 | 5/1980 | Madachy | 242/530.1 |
| 4,204,317 | 5/1980 | Winn | 437/220 |
| 4,927,491 | 5/1990 | Masaki | 437/220 |
| 5,205,503 | 4/1993 | Hutzenlaub | 242/530.3 |

*Primary Examiner*—John P. Darling
*Attorney, Agent, or Firm*—Hickman & Beyer

[57] ABSTRACT

A multi-rail tension equalizer for a reel-to-reel web transfer system. In the web transfer system, the feed stock material is released from one reel containing multiple attached rails. The rails are split using an etching process. The multi-rail tension equalizer has multiple take-up reels. Each take-up reel corresponds to a rail of material. The tension in the take-up rails is equalized by controlling the take-up rate independently for each reel. The reels are mounted on concentric drive shafts each of which are powered by an independently controlled motor.

20 Claims, 9 Drawing Sheets

MULTI-RAIL TENSION EQUALIZER

FIELD OF THE INVENTION

This invention relates generally to manufacturing of devices from a tape feed stock, and in particular, to a tension equalizer for manufacturing systems, which process multiple rails in paralell.

BACKGROUND OF THE INVENTION

Integrated Circuit (IC) chips consist of thousands of transistors. These transistors are organized into circuits for performing certain logic functions. Data and power is communicated to the IC via leads. Typically these leads consist of two parts, namely, an inner lead, which is a thin wire connected to bonding pads on the integrated circuit, and an outer lead, which is thicker and more sturdy than the inner lead.

The IC and the inner lead are usually entirely encapsulated in some form of shell, e.g., epoxy. The connectability of the IC to external circuitry is accomplished by way of the outer leads. The outer leads are given some shape to facilitate the connections between the IC and the external circuitry, e.g., bent so as to enable the positioning of the module in a socket, or bent to provide a suitable surface for soldering to a printer circuit board.

During the manufacturing of ICs the leads are attached to the IC. The first step is the repetitive manufacture of minature printed circuits on a metal tape. Each miniature circuit on the tape is bonded to an IC. The bonds are made between the inner leads and gold bonding pads on the perifery of the IC. These bonds are created simultaneously as the tape passes over an IC attachment tool. At the end of this step, the tape will consist of inner lead circuits with IC bonded to each such circuit.

A lead frame is the metal frame which holds the leads of a circuit package in place before encapsulation. Photolithography, e.g., etching, is used to manufacture lead frames for the semiconductor industry. Manufacturing of lead frames includes both stamping and etching techniques. Etching is used to create finer geometries, i.e., designs in which the individual leads are relatively thin. The material used for manufacturing lead frames may be either in the form of sheets or tape reels.

When the material for the lead frames is in the form of tape reels, the final step of the lead frame manufacturing process, the etching, is done using reel-to-reel equipment, wherein the material is transferred from a product pay-off reel to a product take-up reel. The etching process occurrs between these two reels.

To expand the manufacturing capacity, certain manufacturers of lead frames have adopted multi-rail systems. In such systems one common rail containing multiple tracks of lead frames is passed through the etching process, thereby manufacturing multiple lead frames in parallel. These multiple tracks are then separated into individual rails, each having a width containing the leads that correspond to one IC.

A copper shearing process is one method of separating the common rail into multiple rails. A disadvantage of this method of separating the rails is that the shearing process can create product distortion. Furthermore, the copper shearing process requires an extra handling step, which occassionally leads to damaged products.

"Etch slit" is an alternative method of separating the common rail into multiple rails. Etch slit is a simple modification to the photomask used in the lead frame manufacturing process to create a space between the product rails. This modification to the photomask allows the etch solution to penetrate and "slit" the product into multiple rails.

A problem due to the etch slit step is that as the common rail is separated into multiple rails, the tension in the individual rails varies. If the individual rails are taken up on a common spool then, there is no control of the tension in the individual rails. Thus, there may be slack in some rails and too much tension in others.

A disadvantage of not being able to control the tension in the is that it is more difficult to control the precision with which the lead frames are etched. In some cases the lead frames must be within a width tolerance of ±1 mil. With excessive slack and or tension it is difficult to meet those tolerance requirements.

Clutch drive systems provide one crude solution to the tension control problem in multi-rail systems. In a clutch drive system one reel is driven by a direct drive system. The master reel, in conjunction with the direct drive which rotates it, is used for closed-loop feedback control, i.e., a sensing device determines the rate at which the direct driven reel should turn, and the direct drive rotates the reel at that rate.

The other reels, i.e., the ones not driven by the direct drive, are powered by friction. Friction plates, or spacers, are located between the direct driven reel and the adjacent friction driven reels. If more than one friction driven reel is used, then friction plates may also be located between the various friction driven reels. The friction between the reels enables the various reels to turn in parallel, and allows the friction driven reels to turn at a rate which is slower than the rate of rotation of the direct driven reel.

However, in clutch drive systems the adjacent friction driven reels are not able to turn faster than the direct driven reel. Due to differences in reel diameter at times it is required for the adjacent reels to turn at a higher rate than the direct driven reel. Because it is impossible in a clutch drive system to have the friction driven reels turn faster than the direct driven reel, such systems require human intervention to take up any slack. Furthermore, clutch drive systems rely on friction to control the relative rate of rotation of the various take-up reels in the system. The friction in the clutch drive systems is caused by friction plates rubbing against each other or against reels. This rubbing of material causes the production of particules. Particle production is undesirable in the production of semiconductor integrated circuit modules.

It is therefore desirable to provide a system and method for enabling multiple take-up reels to rotate at different rates, and overcomes the problems described above with reference to the prior art.

SUMMARY OF THE INVENTION

It is an object of the present invention to independently control the tension in each of multiple take-up reels.

It is a further object of the present invention to separate multiple rails of materials from a common reel into separate reels.

It is a further object of the present invention to allow for automatic tension control in each of multiple take-up reels.

According to the invention, there is provided a multi-rail tension equalizer for a reel-to-reel web transfer system. In the web transfer system, the feed stock material is released from one reel containing multiple attached rails. The rails are split using an etching process. The multi-rail tension equalizer has multiple take-up reels. Each take-up reel corresponds to a rail of material. The tension in the take-up rails is equalized by controlling the take-up tension independently for each reel. The reels are mounted on concentric drive shafts each of which are powered by an independently controlled motor.

Still other objects and advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing form the invention. Accordingly, the drawing and description are to be regarded as illustrative in nature, and not as restrictive.

BRIEF DESCRIPTION OF THE DRAWINGS

FIG. 1(*b*) is an illustration of the lead frame of FIG. 1 (*a*) with silicon wafers attached.

FIG. 1(*c*) is a cross-sectional view of a section of the lead frame of FIG. 1(*b*) with an attached silicon wafer.

FIG. 2(*b*) is an elevational view of a second embodiment of a reel-to-reel web transfer system according to the present invention.

FIG. 3(*b*) is an illustration showing a segment of a lead frame product after the etch slit process.

FIG. 5(*b*) is a cross-sectional view of the multi-rail tension equalizer system according to the present invention along line b—b of FIG. 5(*a*).

FIG. 5(*c*) is a cross-sectional view of the multi-rail tension equalizer system according to the present invention along line e—e of FIG. 2(*b*).

FIG. 6(*b*) is a second vertical section of a multi-rail tension equalizer system according to the present invention along line d—d of FIG. 5 (*b*).

DETAILED DESCRIPTION OF THE INVENTION

Figure 1A:
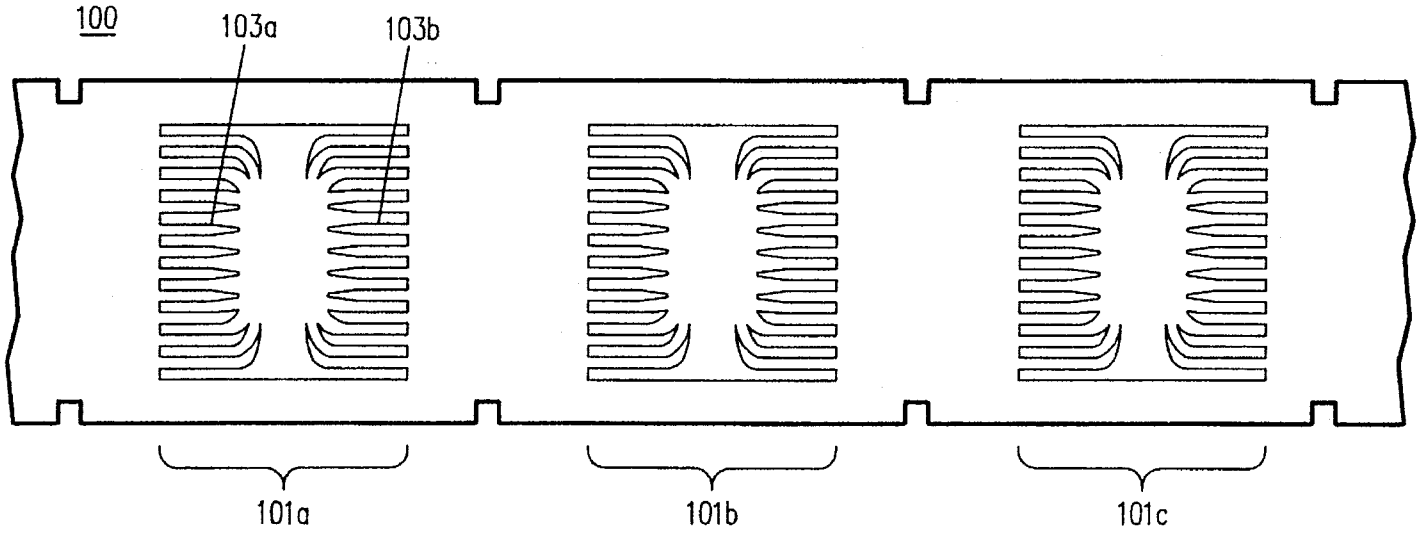
FIG. 1(*a*) is an illustration showing a section of a lead frame.
Figure 1B:
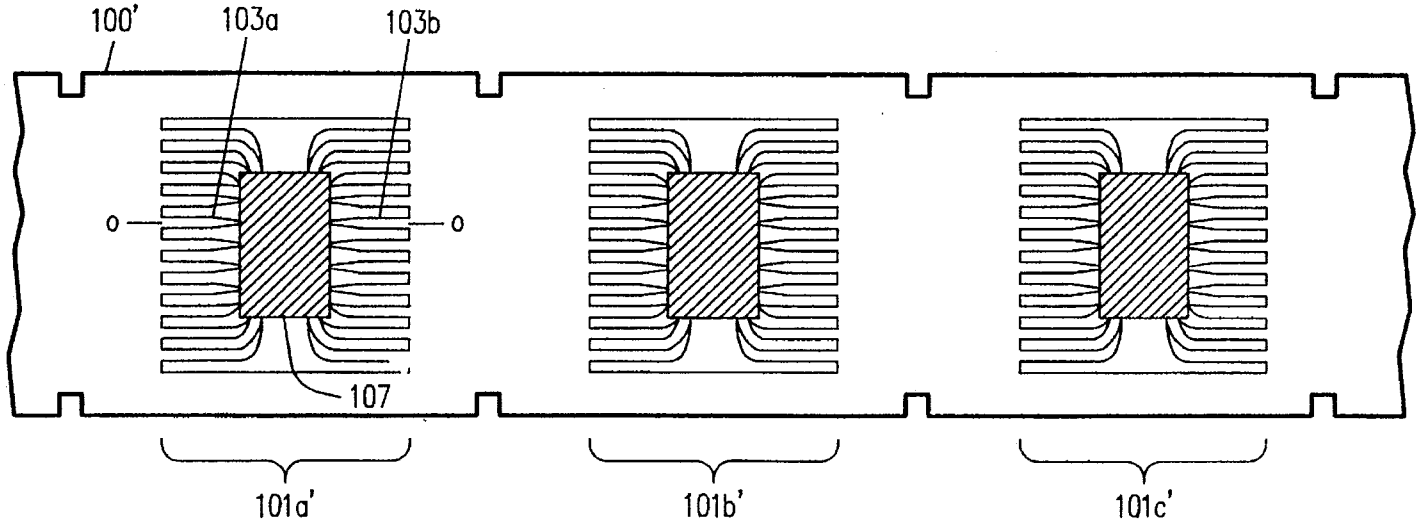
Figure 1C:
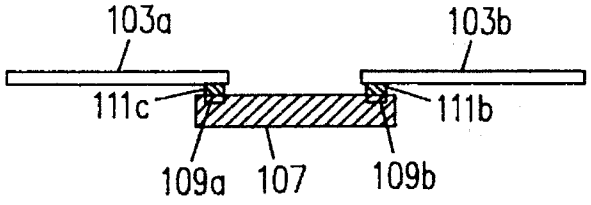

FIG. 1(*a*) is an illustration of a portion of a lead frame 100. The lead frame 100 is manufactured from for example a reel of sheet copper. The reels are for example from product lots of 500 ft. length, 5 inch width and a thickness varying from 2.8 mils to 10 mils. The portion of the lead frame 100 contains lead sets 101*a*, 101*b*, and 101*c*. Each lead set 101*a–c* provides the leads for one integrated circuit module, respectively. A reel of lead frames, of which element 100 is a portion, contains the leads for thousands of IC modules.

Each lead set 101 contains the leads for each pin in the associated integrated circuit. Elements 103*a* and 103*b* are examples of leads. FIG. 1(*b*) is an illustration showing the connection of the leads of the lead frame 100 to an integrated circuit chip 107. In FIG. 1(*b*) the leads of one integrated circuit module 101*a*' have been attached to bond areas on the IC chip 107.

FIG. 1(*c*) is a cross-sectional view of the leads 103*a* and 103*b*, and the IC chip 107 along the line labelled o—o in FIG. 1(*b*). Leads 103*a* and 103*b* are attached to bonding areas 109*a* and 109*b* by solder 111*a* and 111*b*, respectively.

Figure 2A:
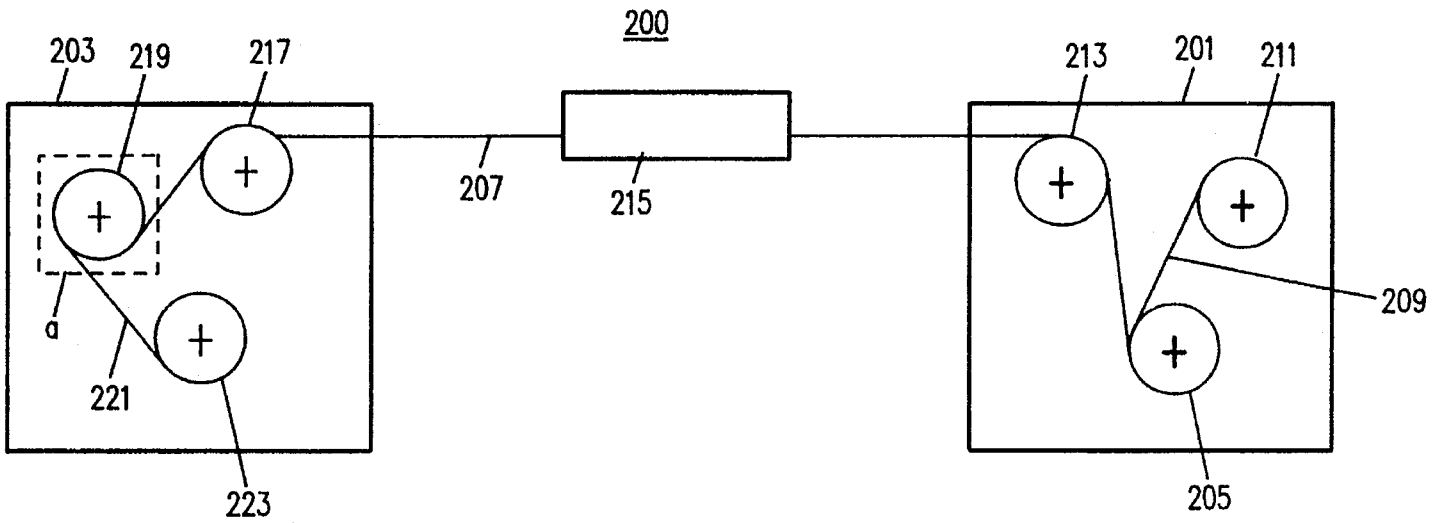
FIG. 2(*a*) is an elevational view of a first embodiment of a reel-to-reel web transfer system according to the present invention.
Figure 2B:
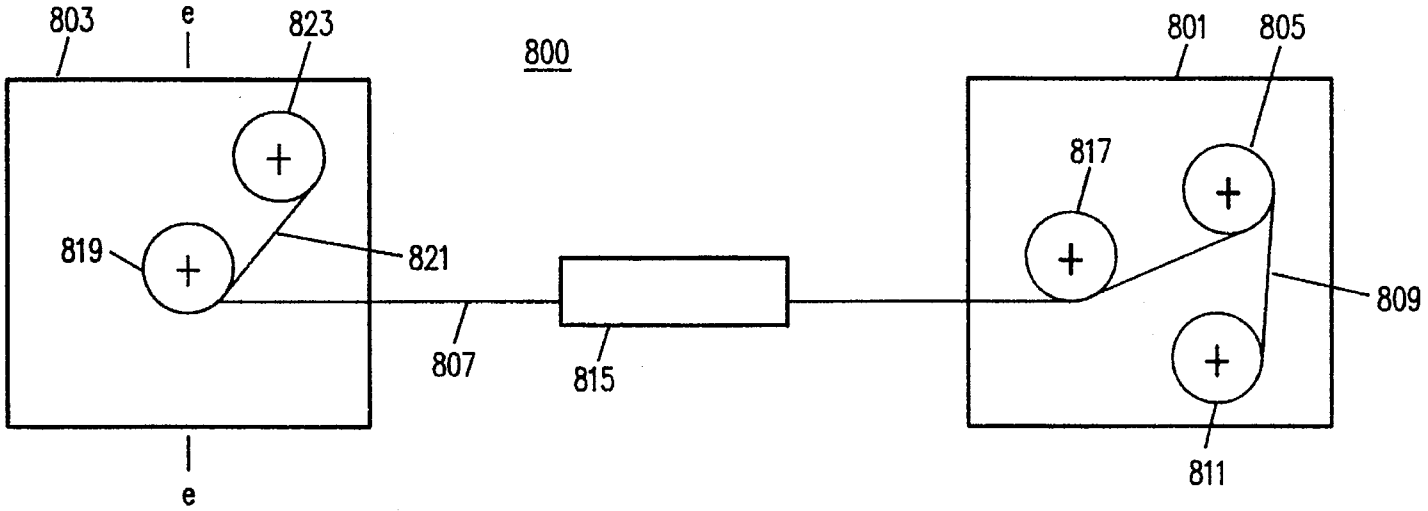

FIG. 2 is an elevational view of a reel-to-reel web transfer system 200 according to the present invention, which consists of a product pay-off reel unit 201 and a product take-up reel unit 203. The product pay-off reel unit 201 drives a product pay-off reel 205. The product pay-off reel 205 holds a spool of copper web 207 interleaved with a mylar sheet 209.

The mylar sheet 209 is taken up on a mylar take-up reel 211. The copper tape is led across a tension sensing roller 213 and into an etching process 215.

From the etching process 215 the copper web is led into the product take-up unit 203 around a speed encoder roller 217 and onto a product take-up reel assembly 219. On the product take-up reel assembly 219 the copper web 207 is interleaved with a mylar sheet 221, which is released from an interleave feed reel 223.

A brake (not shown) is attached to the product pay-off reel 205. The purpose of the brake is to slow down the pay out of the product from the pay-off reel 205. The brake is located, for example, on the axle of the pay-off reel 205.

FIG. 2(*b*) is an elevational view of an alternative embodiment reel-to-reel web transfer system 800, which consists of a product pay-off reel unit 801 and a product take-up reel unit 803. The product pay-off reel unit 801 drives a product pay-off reel 805. The product pay-off reel 805 holds a spool of copper web 807 interleaved with a mylar sheet 809. The rotation speed of the pay-off reel 805 is controlled by an electric motor (not shown) attached to the axle of the pay-off reel 805.

The mylar sheet 809 is taken up on a mylar take-up reel 811. The copper tape is led across a speed encoder roller 817 and into an etching process 815.

From the etching process 815 the copper web is led into the product take-up unit 803 onto a product take-up reel assembly 819. On the product take-up reel assembly 819 the copper web 807 is interleaved with a mylar sheet 821, which is released from an interleave feed reel 823.

The copper web 807 passes under an encoder sensing roller 817. The information gathered by the encoder sensing roller 817, e.g., the tension of the copper web, is fed into the controller for the motor driving the pay-off reel 805.

Figure 3A:
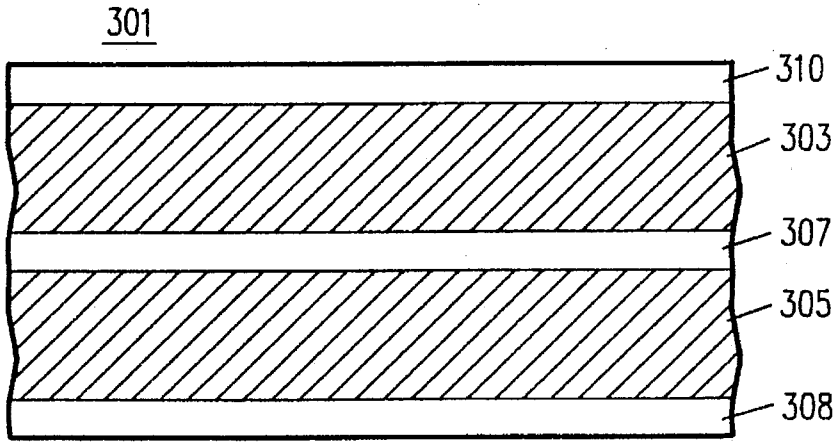
FIG. 3(*a*) is an illustration showing a segment of lead frame product prior to the etch slit.
Figure 3B:
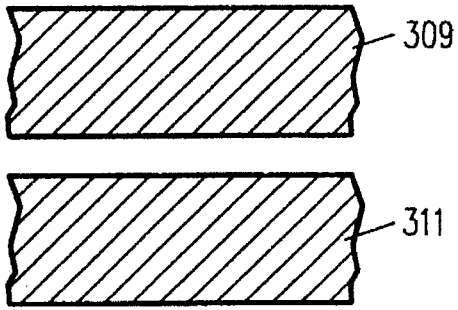

FIG. 3(*a*) is an illustration showing a segment 301 of copper web in which two product rails 303 and 305 are connected by a space 307 which is allotted for the etch slit process. The web, of which section 301 is a segment, also contains margin material 308 and 310. The photo mask for the manufacture of the lead frame includes a modification for the space 307 as well as for the margin material 308 and 310. The space 307 and the margin material 308 and 310 is bare copper not covered by any photo resist material. When the etching process 215 is applied to the segment 301 the etching solution is allowed to penetrate to the copper over the region of the space 307 and the margin material 308 and 310, and thereby slit the web into two separate product rails. FIG. 3(*b*) is an illustration showing the product separated into product rails 309 and 311. Because the space 307, as well as the margin material 308 and 310, has been etched away by the etching process 215, the two product rails 309 and 311 are without connection.

Figure 4:
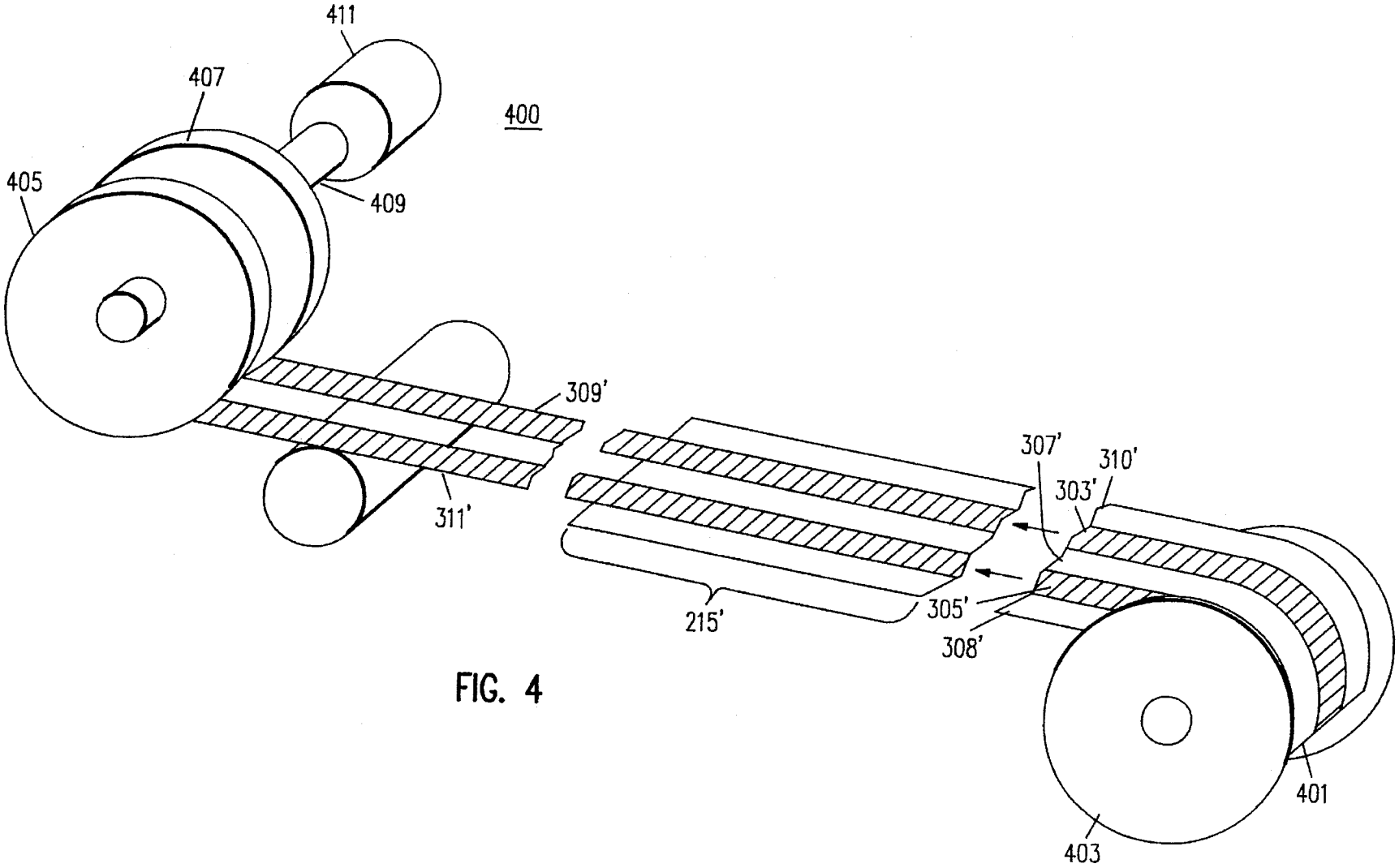
FIG. 4 is a perspective view of a reel-to-reel web transfer system.

FIG. 4 is a perspective view of a multi-rail reel-to-reel web transfer system 400. A roll of copper web 401 containing lead frame material is located on a product reel 403. The copper tape 401 is unrolled from the product reel 403 into an etching process 215'. The copper web 401 contains two product rails 303' and 305' separated by a space 307'. the copper web 401 also contains margin material 308' and 310'.

The copper tape 401 is covered by a photoresist mask. The photoresist prevents etching solution from penetrating to the copper. During the etching process 215' an etching solution is applied to the copper tape 401. The etching solution cannot penetrate those areas covered by the photoresist. The areas not covered by a photoresist mask are dissolved by the etching solution, thereby leaving only the areas covered by the photoresist.

The space 307' and the margin material 308' and 310' is not covered by any photo resist mask. Thus, during the etching process 215' the etching solution is allowed to penetrate the areas of the space 307' and the margin material 308' and 310' thereby removing those areas from the copper tape 401.

Subsequent to the etching process 215' the copper tape 401 has been separated into etch slit product strips 309' and 311'. The product strips 309' and 311' are taken up on take-up reels 405 and 407. The take-up reel 405 is attached to a shaft 409, which is driven by an electric motor 411. The take-up reel 407 is attached to a tension eqalizer (discussed below in conjunction with FIGS. 5 through 7) on a concentric hub. The diameters of the take-up reels 405 and 407 may vary due to differences in the core diameter of the take-up reels. As material is taken up on the take-up reels, the difference in diameter increases. Differences in take-up tension also causes the diameters of the take-up reels 405 and 407 to vary. The differences in diameter causes the take up rate to vary.

Figure 5A:
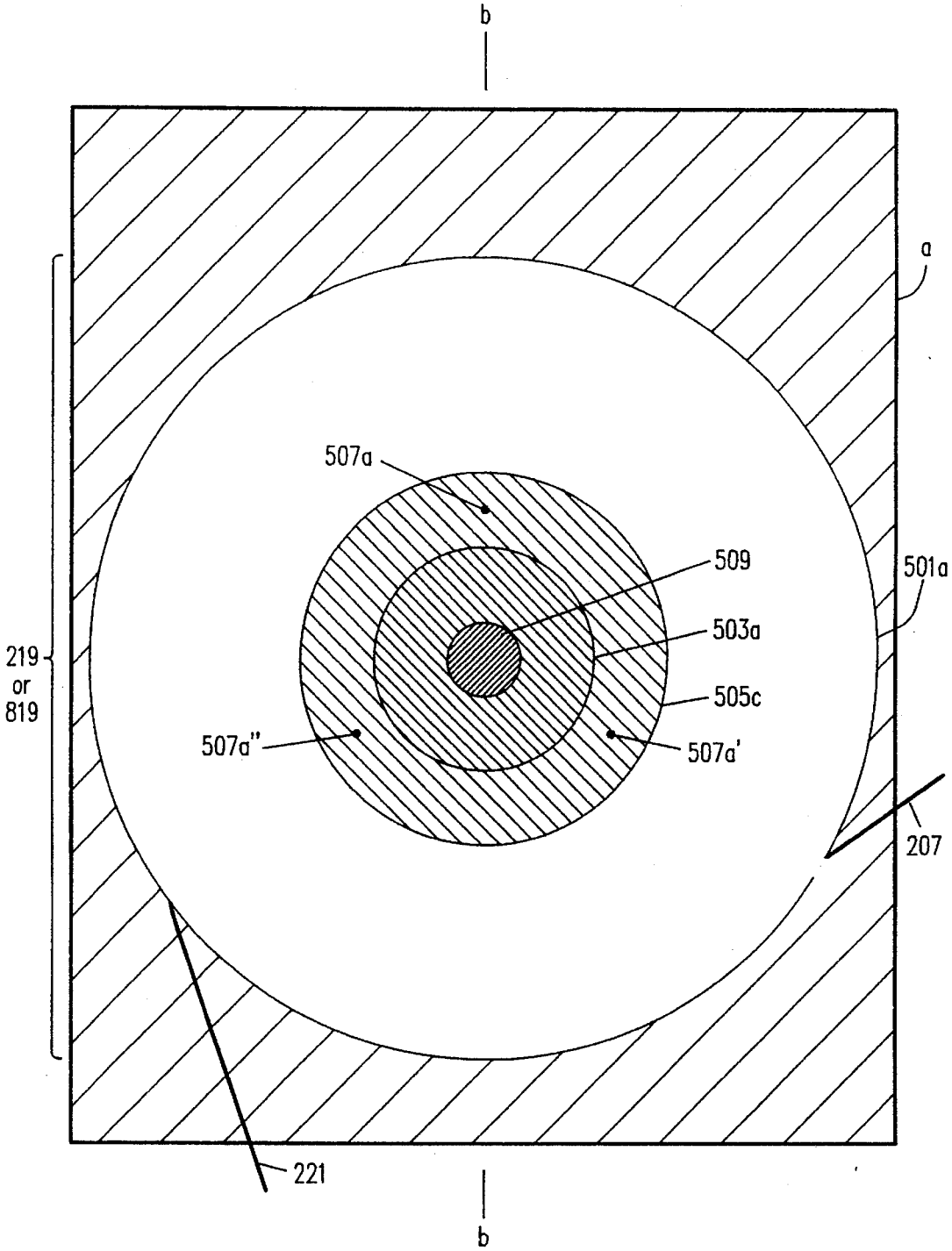
FIG. 5(*a*) is a detailed elevational view of section a of the multi-rail tension equalizer system according to the present invention of FIG. 2.
Figure 5B:
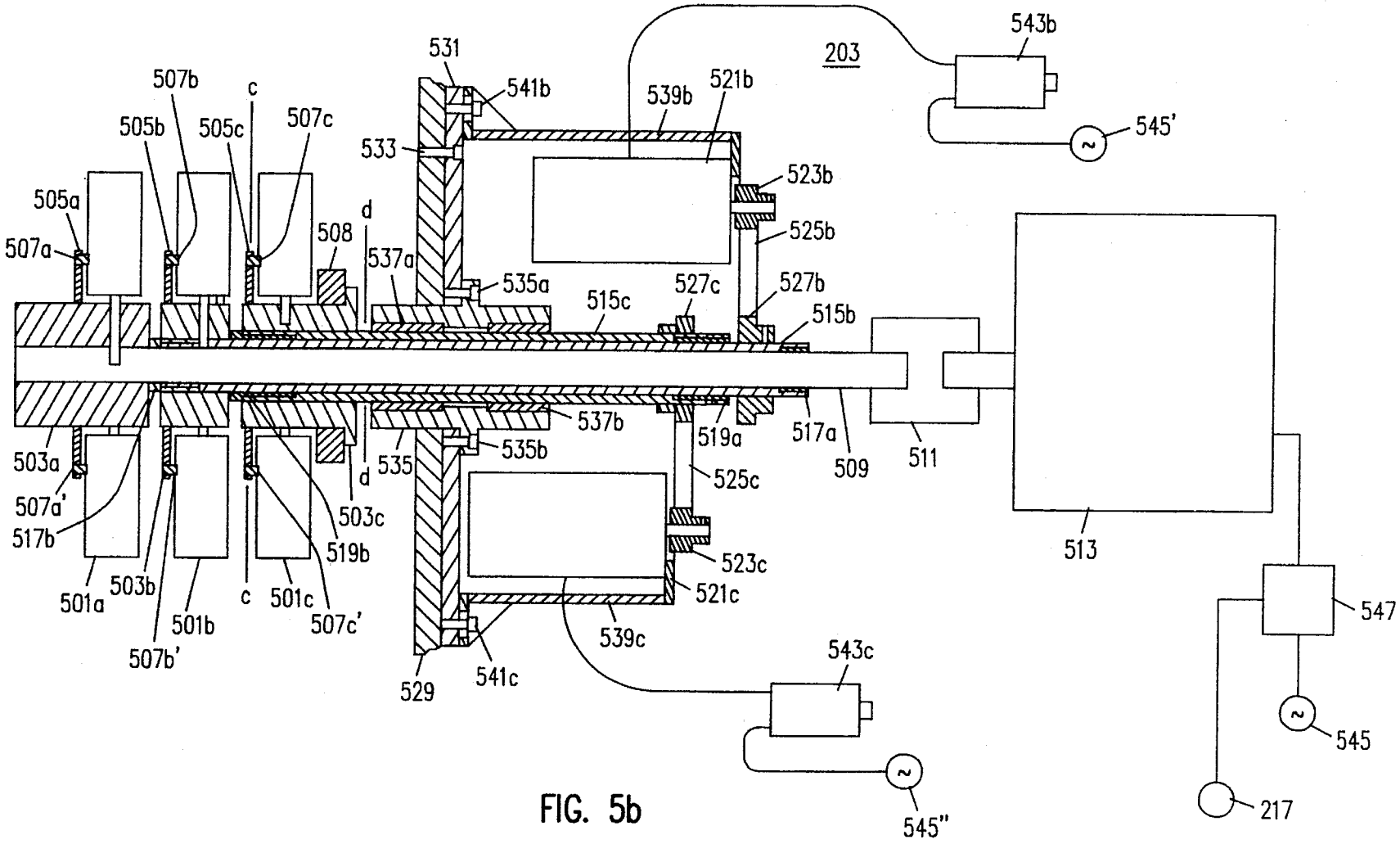
Figure 5C:
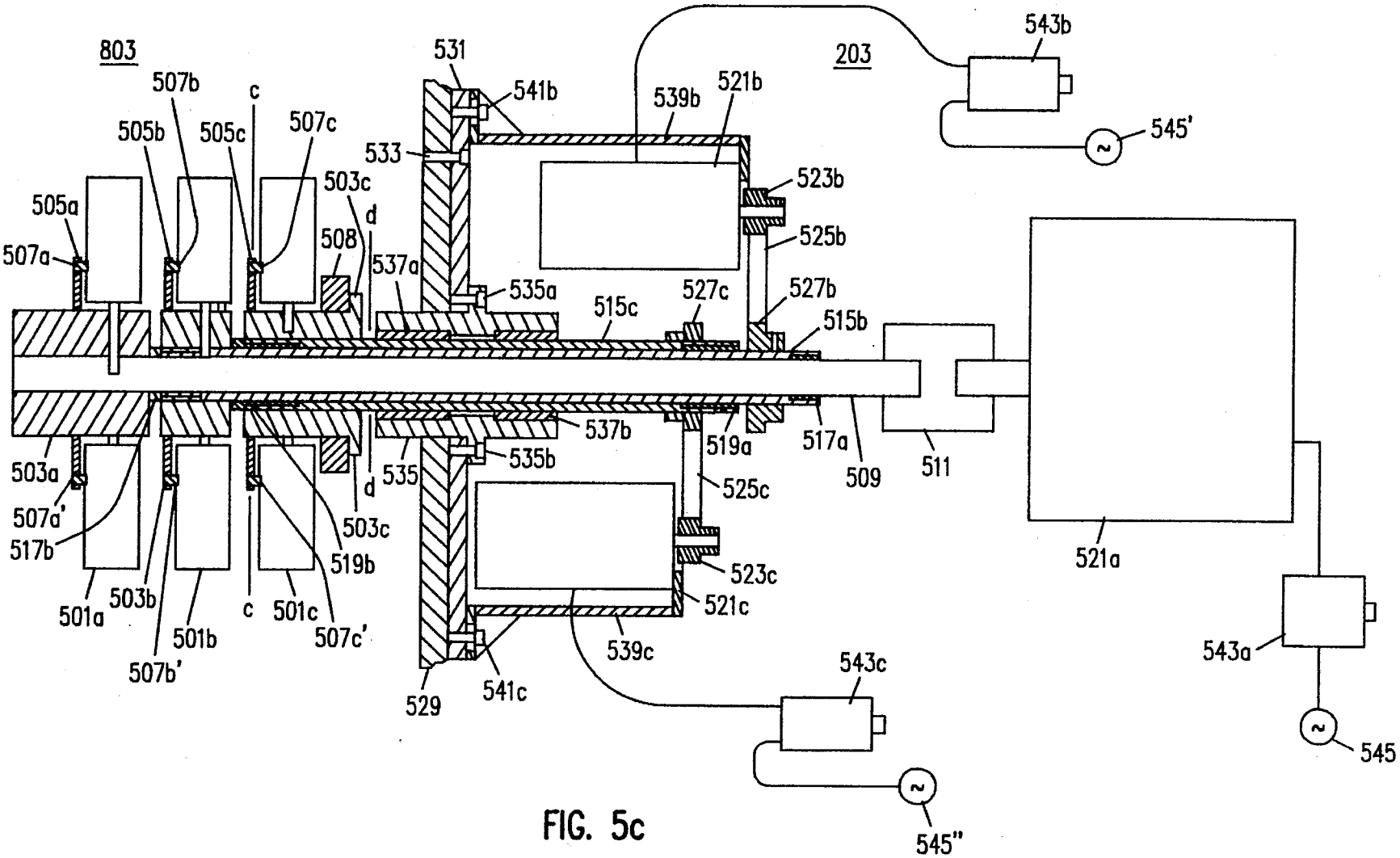

FIG. 5(*a*) is an elevational view of section "a" of the multi-rail tension equalizer system of FIGS. 2(*a*) and 2(b). FIG. 5(*a*) illustrates both the external elements of the product take-up reel assembly 219 of FIG. 2(*a*) and the product take-up reel assembly 819 of FIG. 2(*b*). An outermost reel 501*a* of the reel assembly 219 (and the reel assembly 819) is driven by a drive shaft 509. A reel hub 503*a* is attached to the drive shaft 509, and a reel flange 505*c* is attached to the reel hub 503*a*. A reel 501*a* is mounted to the reel hub 503*a* and secured to the reel flange 505*c* by pins 507*a*, 507*a'*, and 507*a"*.

FIG. 5(*b*) is a cross-sectional view of the multi-rail product take-up unit 203 according to the present invention along line b—b of FIG. 5(*a*). Flanges 505*a*, 505*b*, and 505*c* attach three take-up reels 501*a*, 501*b*, and 501*c* to take-up reel hubs 503*a*, 503*b*, and 503*c*, respectively. The reel 501*a* is secured to the flange 505*a* by pins 507*a* and 507*a'*, the reel 501*b* is secured to the flange 505*b* by pins 507*b* and 507*b'*, and the reel 501*c* is secured to the flange 505*c* by pins 507*c* and 507*c'*.

The reel 501*c* is positioned on the take-up reel hub 503*c* by a spacer 508, which is located adjacent to the reel 501*c*, whereby the reel 501*c* is sandwiched between the spacer 508 and the flange 505*c*. Various size spacers may be used for spacer 508 and various size reels 501 may be used to accomodate different widths of product.

Reel 501*a* is a direct drive reel. The reel hub 503*a* is connected to a drive shaft 509, which is connected by a coupling 511 to a motor 513. The motor 513 is, for example, a ¼ horse-power direct current motor.

Reels 501*b* and 501*c* are both torque driven reels. The reel hubs 503*b* and 503*c* are attached, respectively, to hollow drive shafts 515*b* and 515*c*. The drive shaft 509 is located inside the drive shaft 515*b*, which in turn is located inside the drive shaft 515*c*. The drive shaft 509 is centered inside the drive shaft 515*b* by bushings 517*a* and 517*b*. Similarly, the drive shaft 515*b* is centered inside the drive shaft 515*c* by bushings 519*a* and 519*b*. The bushings 519*a* and 519*b* enable the drive shaft 515*c* to smoothly and independently rotate about the drive shaft 515*b*.

The hollow drive shafts 515*b* and 515*c* are powered by torque motors 521*b* and 521*c*, respectively. Attached to the torque motor 521*b* is a pinion gear 523*b*, and attached to the torque motor 521*c* is a pinion gear 523*c*. Power is transmitted from the torque motor 521*b* to the drive shaft 515*b* by a power transmission belt 525*b* connected between the pinion gear 523*b* and a drive gear 527*b* which is attached to the drive shaft 523*b*. Similarly, power is transmitted from the torque motor 521*c* to the drive shaft 515*c* by a power transmission belt 525*c* connected between the pinion gear 523*c* and a drive gear 527*c* which is attached to the drive shaft 523*c*.

The three drive shafts 509, 515*a* and 515*b*, extend through a reel handler mounting plate 529. An inner mounting plate 531 is attached to the reel handler mounting plate 529 by bolts 533. A bushing housing 535, having an interior surface, extends through the reel handler mounting plate 529 and the inner mounting plate 531, to which the bushing housing 535 is attached by bolts 535*a* and 535*b*. Bushings 537*a* and 537*b* are attached to the interior surface of the bushing housing 535, at each end of the bushing housing 535, respectively. The drive shafts 509, 515*b* and 515*c* are centered in the bushing housing 535 by the bushings 537*a* and 537*b*, and the drive shaft 515*c* rotates in the bushings 537*a* and 537*b*.

The torque motor 521*b* is attached to the inner mounting plate 531 by a bracket 539*b*, and the torque motor 521*c* is attached to the inner mounting plate 531 by a bracket 539*c'*. The brackets 539*b* and 539*c* are attached to the inner mounting plate by bolts 541*b* and 541*c*, respectively.

The torque motor 521*b* is electrically connected to a variable transformer 543*b*, and the torque motor 521*c* is electrically connected to a variable transformer 543*c*. The variable transformers 543*b* and 543*c* are connected to a power source 545' and 545", e.g., a 220 volt electric net. The tension in the rails corresponding to reels 501*b* and 501*c* is adjusted by adjusting the power supplied by the transformers 543*b* and 543*c* to the torque motors 521*b* and 521*c*, respectively. A characteristic of the torque motors 521*b* and 521*c* is that they may be stalled indefinitely. A further characteristic of the torque motors 521*b* and 521*c* is that as power is increased to the torque motors the torque provided by the torque motor is increased.

The speed at which the motor 513 is driven is controlled by a closed-loop controller 547 which is connected between a power source 545 and the motor 513. The closed-loop controller 547 is connected to the encoder roller 217. The speed at which the take-up reels 501*a*, 501*b*, and 501*c* are driven is controlled by the rotation speed of the motor 513. The speed of the take-up reels 501*a*, 501*b*, and 501*c* are dependent on one another by virtue of the fact that the rails which are taken up by each of the reels 501*a*, 501*b*, and 501*c* originate from a common rail.

FIG. 5(*c*) is a cross-sectional view of the multi-rail product take-up unit 803 along the line labelled e—e in FIG. 2(*b*). FIG. 5(*c*) corresponds to the cross-sectional view of FIG. 5(*b*). The only difference between FIG. 5(*b*) and FIG. 5(*c*is that the centermost driveshaft 509 of FIG. 5(*c*is driven by a torque motor 521*a*. The torque motor 521*a* is shown as coupled to the drive shaft 509 via coupling 511. A person skilled in the art will realize that the coupling of between the drive shaft 509 and the torque motor 521*a* can be accomplished using belt drive mechanisms as is shown for the connections of the torque motors 521*b* and 521*c* to drive shafts 515*b* and 515*c*, respectively.

The torque motor 521*a* is connected to a power source 545 via a variable power supply 543*a* for controlling the speed of the torque motor 521*a*.

Figure 6A:
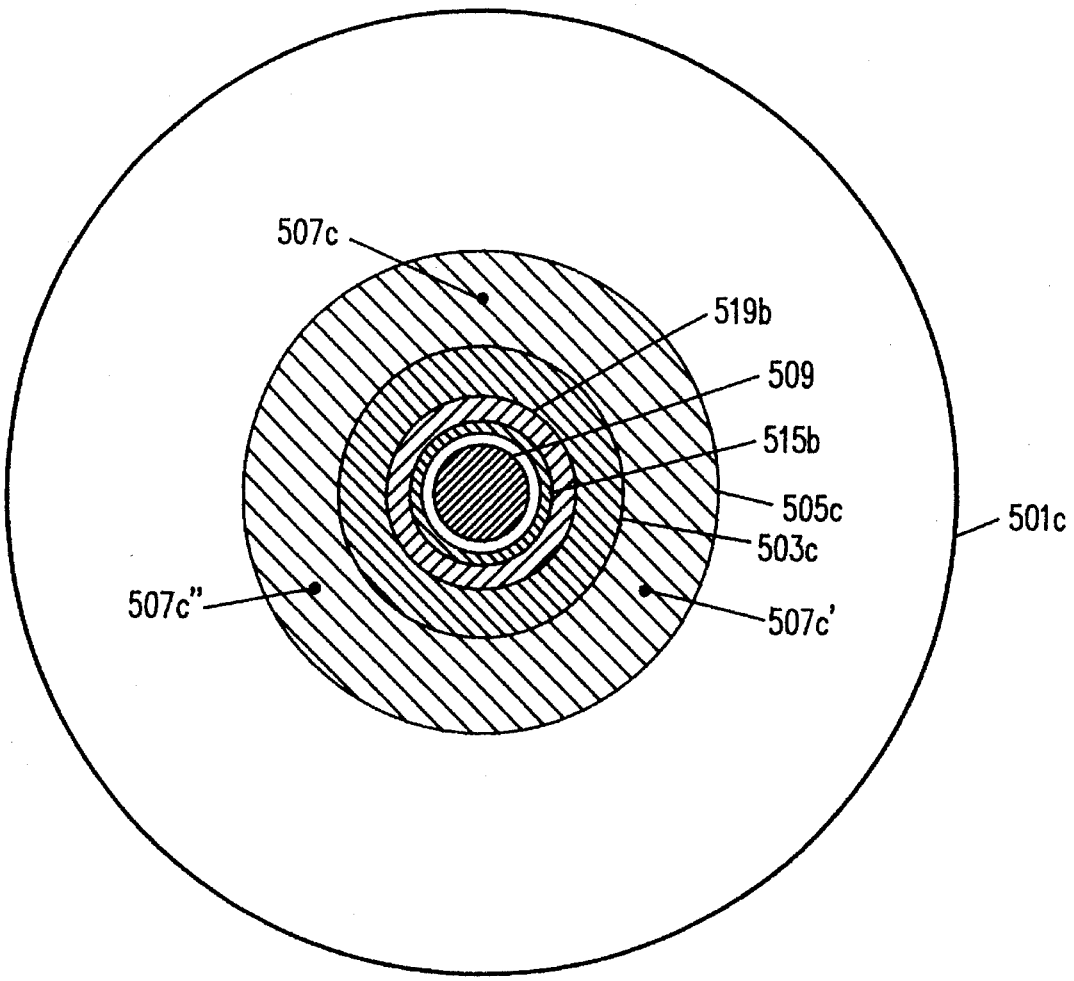
FIG. 6(*a*) is a first vertical section of a multi-rail tension equalizer system according to the present invention along line c—c of FIG. 5(*b*).
Figure 6B:
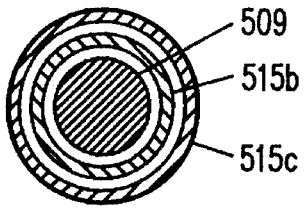

FIG. 6(*a*) is a vertical sectional view of the tension equalizer system 500 according to the present invention along the line c—c of FIGS. 5(*b*) and 5(*c*). Located innermost is the drive shaft 509. The drive shaft 509 is located inside the hollow drive shaft 515*b*. By virtue of not being in direct contact with one another, drive shaft 509 and, drive shaft 515*b* rotate independent and smoothly with respect to each other. The drive shaft 515*b* rotates in the bushing 519*b*. The bushing 519*b* is attached to the hollow drive shaft 515*c* (which is obscured by the bushing 519*b* in FIG. 6). Drive shafts 515*b* and 515*c* rotate independent of one another. The drive shaft 515*c* is further attached to the reel hub 503*c*. The reel hub 503*c* is attached to the flange 505*c*. The reel 501*c* is mounted on the reel hub 503*c*, and is secured to the flange 505*c* by pins 507*c*, 507*c*', and 507*c*".

FIG. 6(*b*) is a cross-sectional view of the multi-rail tension equalizer 500 along the line d—d of FIGS. 5(*b*) and 5(*c*). Located innermost is the drive shaft 509. The drive shaft 509 is located inside the hollow drive shaft 515*b*. Similarly, the hollow drive shaft 515*b* is located inside the hollow drive shaft 515*c*. Because there is no direct connection between the drive shaft 509, the hollow drive shaft 515*b* and the hollow drive shaft 515*c*, the drive shaft 509, the hollow drive shaft 515*b* and the hollow drive shaft 515*c* rotate independently of one another.

Thus, drive shafts 509, 515*b* and 515*c* are concentric drive shafts which are separated from one another by bushings 519*a* and 519*b* between drive shafts 515*b* and 515*c*, and by bushings 517*a* and 517*b* between drive shafts 515*b* and 509.

Figure 7:
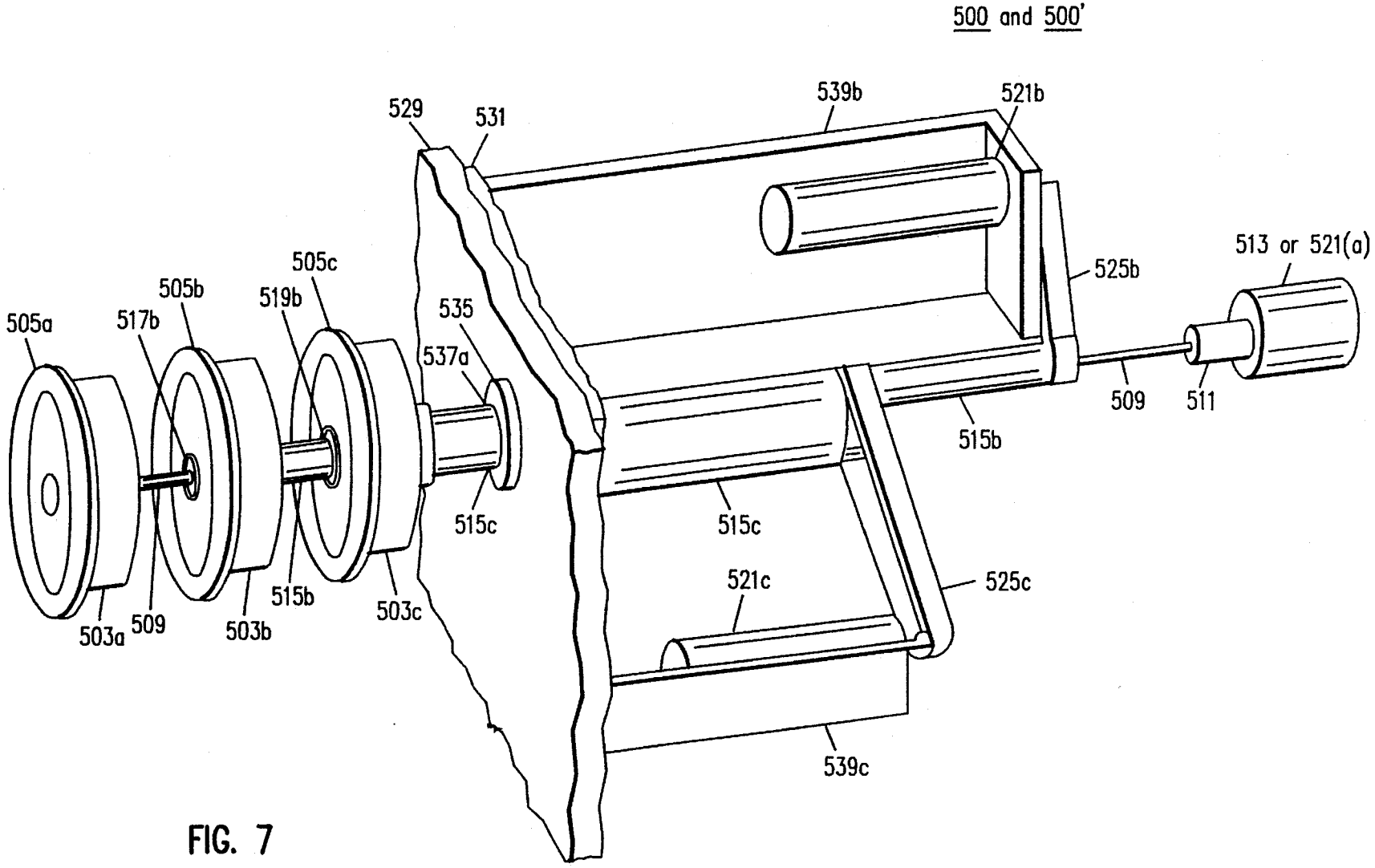
FIG. 7 is perspective view of a multi-rail tension equalizer system according to the present invention.

FIG. 7 is a perspective view of the multi-rail tension equalizer 500 and 500'. The direct driven reel hub 503*a* is attached to the drive shaft 509. The drive shaft 509 is driven by motor 513 of FIG. 5(*b*) or torque motor 521*a* of FIG. 5(*c*), which is attached to drive shaft 509 by coupling 511. The drive shaft 509 is centered inside the hollow drive shaft 515*b* by bushing 517*b*.

The reel hub 503*b* is attached to the hollow drive shaft 515*b*. The hollow drive shaft 515*b* is powered by the torque motor 521*b*. The drive belt 525*b* connects the output pinion gear of the torque motor 521*b* to the hollow drive shaft 515*b*. The hollow drive shaft 515*b* is centered inside the hollow drive shaft 515*c* by bushing 519*b*.

The reel hub 503*c* is attached to the hollow drive shaft 515*c*. The hollow drive shaft 515*c* is powered by the torque motor 521*c*. The drive belt 525*c* connects the output pinion gear of the torque motor 521*c* to the hollow drive shaft 515*b*. The hollow drive shaft 515*c* extends through the reel handler mounting plate 529 and the inner mounting plate 531. The hollow drive shaft 515*c* rotates in the bushing 537*a*, which is located inside the bushing housing 535. The bushing housing 535 extends through the reel handler mounting plate 529 and the inner mounting plate 531, and the bushing housing 535 is secured to the inner mounting plate 531.

Flanges 505*a*, 505*b*, and 505*c* are attached to reel hubs 503*a*, 503*b*, and 503*c*, respectively. The reels 501*a*, 501*b*, and 501*c* (not shown in FIG. 7), are mounted on reel hubs 503*a*, 503*b*, and 503*c*, and secured to the flanges 505*a*, 505*b*, and 505*c*, respectively.

Note that for the alternative embodiment multi-rail reel-to-reel web transfer system 800, the cross-sectional views along lines c—c and d—d respectively are identical to those for the same cross-sections in FIG. 5(*b*). Therefore, FIGS. 6(*a*) and 6(*b*) are applicable to the alternative embodiment illustrated in FIGS. 2(*b*) and 5(*b*).

Although the invention has been described with reference to specific embodiments, this description is not meant to be construed in a limiting sense. Various modifications of the disclosed embodiment, as well as alternative embodiments of the invention will become apparent to persons skilled in the art upon reference to the description. For example, whereas the invention has been described in the context of lead frame manufacturing, a person skilled in the art will realize that the invention may be used in other applications that involve reel-to-reel transfer of material, e.g., paper, plastic, or other metal applications. A person skilled in the art will realize that where a bushing is used a bearing may be used. A person skilled in the art will realize that where drive belts are used, arrangements using gears and/or drive shafts may be used. A person skilled in the art will realize additional modifications and alternative embodiments, and it is, therefore, contemplated that the appended claims will cover such modifications that fall within the true scope of the invention.

I claim:

1. An apparatus for independently controlling the tension in each reel in a reel-to-reel material transfer system having multiple takeup reels, comprising:

a first drive shaft having a first end and a second end;

a first cylindrical drive shaft having an interior bore, a first end and a second end, wherein said first drive shaft is located inside said interior bore and wherein both said first end of said first drive shaft protrudes from said interior bore beyond said first end of said first cylindrical drive shaft and said second end of said drive shaft protrudes from said interior bore beyond said second end of said cylindrical drive shaft;

a first reel hub for mounting a first take-up reel and connected to a first end of said first drive shaft;

a second reel hub for mounting a second take-up reel and connected to a first end of said first cylindrical drive shaft;

a first motor connected to said second end of said first drive shaft; and a first torque motor connected to said second end of said first cylindrical drive shaft.

2. The apparatus of claim 1, further comprising:

a variable power source connected to said first torque motor and operable to control the torque output by said first torque motor.

3. The apparatus of claim 1, further comprising:

a first drive belt for connecting said first torque motor to said second end of said cylindrical drive shaft.

4. The apparatus of claim 1, further comprising:

a second cylindrical drive shaft having an interior bore, a first end and a second end; wherein said first cylindrical drive shaft is located inside said interior bore; and a third reel hub for mounting a third take-up reel and connected to said first end of said second cylindrical drive shaft.

5. The apparatus of claim 4, further comprising:

a second torque motor connected to said second end of said third drive shaft.

6. The apparatus of claim 5, further comprising:

a second variable power source connected to said second torque motor and operable to control the torque output by said second torque motor.

7. The apparatus of claim 1, further comprising:

a first bushing located in said interior bore of said first cylindrical drive shaft and attached at said first end of said first cylindrical drive shaft; and a second bushing located in said interior bore of said first cylindrical drive shaft and attached at said second end of said second end of said first cylindrical drive shaft;

wherein said first drive shaft rotates in said first and second bushings.

8. A reel-to-reel material transfer system, comprising:

a base;

a product release unit mounted on said base and operable to release material;

a product splitter mounted on said base so that material from said product release unit passes through said product splitter, and operable to split said material into a plurality of rails; and a material take-up unit mounted on said base and having a plurality of take-up reels operable to take-up said plurality of rails from said product splitter, wherein said rails are taken up one rail on each reel, said material take-up unit having:

a plurality of concentric drive shafts, each drive shaft attached at one end to one of said take-up reels, respectively, and a second end connected to a motor, wherein said motors are independently controllable so that each said take-up reel rotates at a rate independent of each other said take-up reel.

9. The reel-to-reel material transfer system of claim 8, wherein said product splitter splits said material using an etching process.

10. The reel-to-reel material transfer system of claim 8, wherein said product splitter splits said material using a stamping process.

11. The reel-to-reel material transfer system of claim 8, wherein a first of said motors is an electric motor; and each other said motor is a torque motor.

12. The reel-to-reel material transfer system of claim 8, further comprising:

a plurality of variable power sources each connected to one of said motors, respectively.

13. The reel-to-reel material transfer system of claim 12, wherein said variable power sources are adjustable transformers.

14. The reel-to-reel material transfer system of claim 8, wherein said concentric drive shafts comprise:

an innermost drive shaft; and a plurality of cylindrical drive shafts each having an interior bore, one of said drive shafts being an outermost drive shaft wherein said innermost drive shaft is located in said interior bore of one of said cylindrical drive shafts, and wherein each said cylindrical drive shaft, except said outermost drive shaft, is located in the interior bore of another said cylindrical drive shaft.

15. The reel-to-reel material transfer system of claim 14, further comprising:

a plurality of bushings located in the interior bore of each said cylindrical drive shaft, thereby separating each said cylindrical drive shaft from the drive shaft in its interior bore.

16. A method of separating material on one reel into a plurality of rails, each of which is taken up on a separate reel, comprising the steps of:

(a) mounting said one reel on a product release unit;

(b) releasing said material from said product release unit;

(c) subjecting said material to an etching process and passing said material through a product splitting unit, wherein said material is split into said plurality of rails;

(d) taking up said plurality of rails on separate reels; and (e) controlling the rotation rate of each said separate reel independently from the rotation rate of each other said separate reel by independently driving each said separate reel.

17. A method of separating material on one reel into a plurality of rails, each of which is taken up on a separate reel, comprising the steps of:

(a) mounting said one reel on a product release unit;

(b) releasing said material from said product release unit;

(c) passing said material through a product splitting unit, wherein said material is split into said plurality of rails;

(d) taking up said plurality of rails on separate reels; and (e) controlling the rotation rate of each said separate reel independently from the rotation rate of each other said separate reel by, (e.1) rotating each said separate reel using a separate motor for each said separate reel, (e.2) supplying electrical power to each said separate motor, and (e.3) controlling the supply of electrical power to each said motor.

18. An apparatus for independently controlling the tension in each reel in a reel-to-reel material transfer system having multiple take-up reels, comprising:

a first drive shaft having a first end and a second end;

a first cylindrical drive shaft having an interior bore, a first end and a second end, wherein said first drive shaft is located inside said interior bore and wherein both said first end of said first drive shaft protrudes from said interior bore beyond said first end of said first cylindrical drive shaft and said second end of said drive shaft protrudes from said interior bore beyond said second end of said cylindrical drive shaft;

a first reel hub for mounting a first take-up reel and connected to a first end of said first drive shaft;

a second reel hub for mounting a second take-up reel and connected to a first end of said first cylindrical drive shaft;

a first torque motor connected to said second end of said first drive shaft; and a second torque motor connected to said second end of said first cylindrical drive shaft.

19. The apparatus of claim 18, further comprising:

a first power source connected to said first torque motor and operable to control the torque output by said first torque motor; and a second power source connected to said second torque motor and operable to control the torque output by said second torque motor.

20. The apparatus of claim 18, further comprising:

a first drive belt for connecting said first torque motor to said second end of said first drive shaft; and a second drive belt for connecting said second torque motor to said second end of said first cylindrical drive shaft.

* * * * *